US005927576A

United States Patent [19]

Nielsen

[11] Patent Number: 5,927,576

[45] Date of Patent: Jul. 27, 1999

[54] INFANT CARRIER SLING

[75] Inventor: Helga Nielsen, Odense, Denmark

[73] Assignee: Connie-Selen ApS, Odense S, Denmark

[21] Appl. No.: 08/820,984

[22] Filed: Mar. 19, 1997

[30] Foreign Application Priority Data

Mar. 19, 1996 [DK] Denmark ..... 0315/96

[51] Int. Cl.[6] ..... A61G 1/00

[52] U.S. Cl. ..... 224/161; 224/160

[58] Field of Search ..... 224/158, 159, 224/160, 161; D3/213, 214

[56] References Cited

U.S. PATENT DOCUMENTS

| | | | |
|---|---|---|---|
| D. 357,800 | 5/1995 | Roan et al. | D3/214 |
| D. 370,996 | 6/1996 | Shimura et al. | D3/213 |
| 3,780,919 | 12/1973 | Hansson | 224/160 |
| 3,841,543 | 10/1974 | Bolton | 224/158 |
| 4,428,514 | 1/1984 | Elf | 224/160 |
| 4,434,920 | 3/1984 | Moore | 224/160 |
| 4,730,759 | 3/1988 | Naidu | 224/158 |
| 5,205,451 | 4/1993 | Manzer | 224/161 |
| 5,361,952 | 11/1994 | Gold | 224/159 |

FOREIGN PATENT DOCUMENTS

| | | | |
|---|---|---|---|
| 92/16130 | 10/1992 | WIPO | 224/160 |

*Primary Examiner*—Allan N. Shoap
*Assistant Examiner*—Gregory M. Vidovich
*Attorney, Agent, or Firm*—Sixbey, Friedman, Leedom & Ferguson; David S. Safran

[57] ABSTRACT

A carrying sling for infants, having a cushion-like seating part (1) in which a baby can be seated and securely fastened, and shoulder straps (6,8) so that the baby can be carried preferably at the chest of a carrier, where the cushion-like seating part is fixedly connected to two shoulder straps (6,8) and a tightening buckle strap (2), each end of the buckle strap (2) going around the baby and through respective buckles (12) on the shoulder straps (6,8), so that the baby can be pulled tightly towards the body of the carrier when the buckle strap ends are pulled through the buckles (12).

9 Claims, 1 Drawing Sheet

FIG. 1
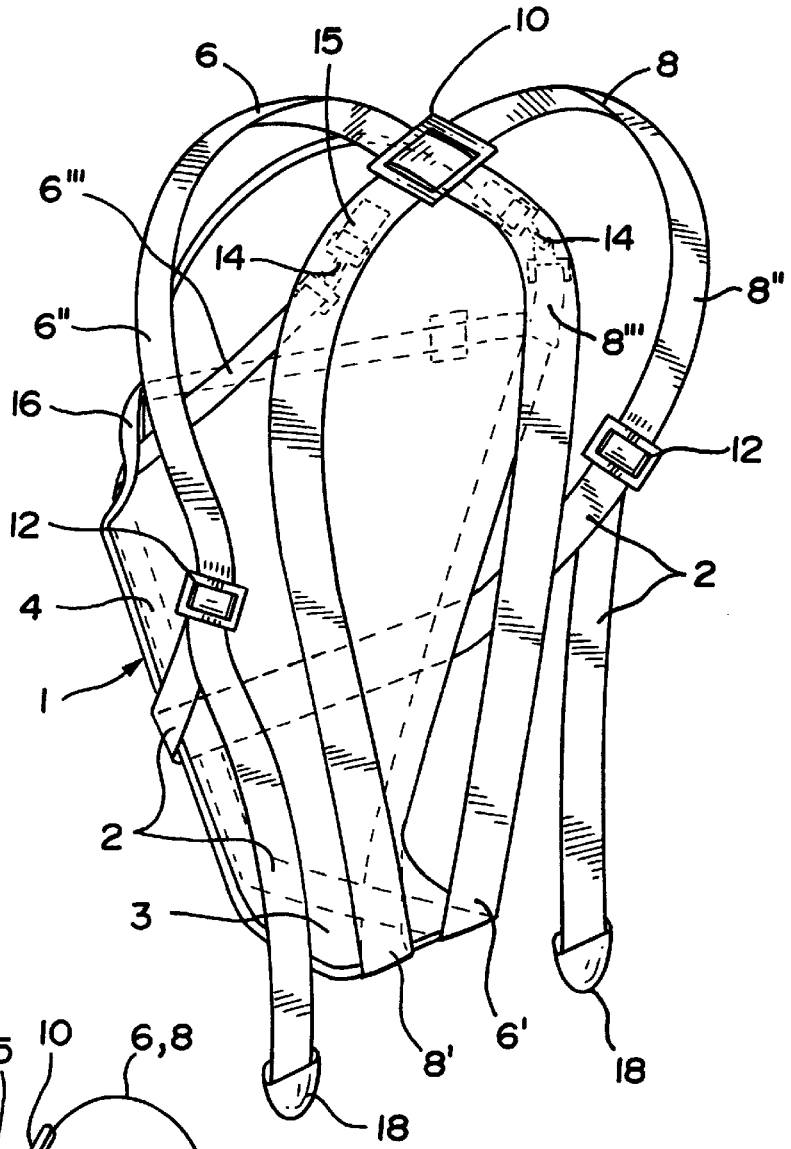
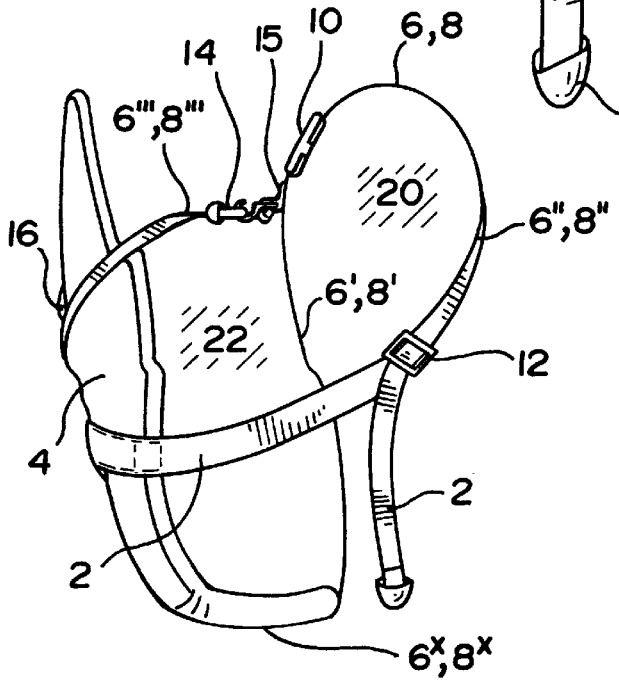
FIG. 2

INFANT CARRIER SLING

BACKGROUND OF THE INVENTION

The present invention relates to a carrying sling for infants, comprising a seat part in which a baby can be seated and securely fastened, and shoulder straps so that the baby can be carried at the back or preferably at the chest of a carrier.

With carrying slings of such a type an infant can be carried in a simple manner at the chest or the back, which is convenient for the carrier, who can then carry the baby and at the same time have both hands free, and for the baby, who, in such a sling, is sitting in close contact with the carrier.

By these known carrying slings the baby is strapped by means of strap belts in a bag shaped seat part. This seat part is further provided with shoulder straps that can be tightened around the shoulders of the carrier, so that the baby in the sling hangs close against the chest or back of the carrier.

When the carrier is walking with the baby in such a carrying sling it may occur that the sling will swing with a frequency that does not correspond to the walking rhythm of the carrier, which feels uncomfortable for the carrier as well as the baby.

SUMMARY OF THE INVENTION

Therefore, it is the purpose of the invention to provide a more comfortable carrier sling.

The invention provides for a carrier sling comprising a seat and backrest cushion plate unit, a lower portion of which is suspended in a carrier shoulder strap, while an upper portion thereof is transversely strap connected or connectable with an upper area of the same shoulder strap, and an intermedate or lower and foremost portion of said seat and backrest cushion plate unit being strap connected or connectable with the opposite end of said shoulder strap through a length adjustable coupling therewith.

As a result of this design, a tightening of the carrier's shoulder straps will imply a tightening of the lower part of the seat unit of the carrier sling against the carrier's body as well as a firm supporting of the sling, while still providing free space for the infant's breast and head portion owing to the said uppermost, more or less horizontal strap connections. Thus, the sling unit as a whole will be bound to closely follow the movements of the carrier person, without oscillations independent thereof. Thus, the desired result is achievable in an extremely simple and advantageous manner. Moreover, in using the said length adjustable coupling the user may adjust the sling to suit both the baby and the user.

BRIEF DESCRIPTION OF THE DRAWINGS

The invention is further described in more detail with reference to the drawing, in which:

FIG. 1 is a perspective view of a preferred embodiment of a carrier sling according to the invention, and FIG. 2 is a side view thereof.

DETAILED DESCRIPTION OF THE PREFERRED EMBODIMENT

The illustrated carrier sling has a seat and backrest cushion plate member 1 with a head and backrest portion 4, which is downwardly narrowing towards a lower, forwardly projecting seat plate portion 3 enabling the infant to be seated astride this portion. The plate member is a flexible foam plate covered by cloth on both sides and quilted at its lower end portion for reinforcing the seat portion, though still with the possibility of automatically adjusting the depth dimension of the seat to match the size of the infant, still with full back support all the way down.

The cushion plate member 1 is provided with two shoulder carrier straps 6,8 that are fixed preferably by sewing to the rear side of the plate member 1. The carrier straps 6,8 have free end portions 6''',8''' situated at shoulder portions of the backrest cushion portion 4 and terminated by respective join buckles 14. On the rear side of the plate member 1 the carrier strap portions 6''',8''' extend from the 6,8, on shoulder portions down to and along the plate portion 3 crossing each other at the underside thereof and thereby providing for an extra safe support of the infant. From the front edge of the plate portion 3 the carrier straps extend upwardly into respective carrier 6',8' extending up along the body of the carrier and passing up to the said shoulder carrier straps 6,8 where they are provided with connector strap pieces 15 terminated by connector means for co-operation with the join buckles 14, such that there is provided ample space for the infant's head between the backrest cushion portion 4 and the body of the carrier. The carrier straps 6,8 extend further through a cross buckle 10 in which the straps 6,8 cross each other and can be length adjusted. From here the carrier straps 6,8 extend further into respective carrier's shoulder strap sections and extending further downwardly therefrom, at 6",8", on the opposite side of the carrier and terminated by a buckle 12.

Between the seat plate portion 3 and the shoulder portions of the backrest cushion portion 4 a buckle strap 2 extending in a transverse direction is fixed to the backrest, preferably by sewing. At each side of the backrest cushion portion 4 this buckle strap 2 extends forwardly through the buckles 12 of the carrier straps 6",8" and further into free end portions, where it is fitted with a D-ring 18 at each end.

The first mentioned end sections 6''',8''' of the carrier straps 6,8 at the shoulder portions of the backrest 4 are at the rear side of the backrest cushion portion 4 connected with a transverse adjustment strap 16. The length of this strap 16 can be adjusted by means of a buckle which is located on the rear side of the backrest cushion portion 4 and is therefore merely shown in phantom outline in FIG 1.

The purpose of the length adjustability of this strap 16 is to enable an adjustment of the distance between the upper part of the head- and backrest cushion portion 4 and the body of the carrier to thereby match the size of the infant. Alternatively, of course, the length of the interconnected strap end portions 15 and 6 could be otherwise length adjustable.

It will be appreciated that the straps 6,8 will serve to carry the sling both vertically at the front end of the seat part 3 and by an inclined pull inwardly against the carrier's body through the strap 2 and the rear portions of the straps 6,8, still with ample space for the infant's head at the top of the sling.

The carrier sling is adapted to function in the following manner:

The infant is placed in the carrier structure 1. Then the carrier straps 6',8' located in area 22 are laid up along the infant and at the end of the supporting section of said straps 6,8 are linked to the respective sides of the shoulder portions of the backrest cushion portion 4 by the buckles 14, whereby the infant is held in place. The carrier can then put the shoulder sections of the carrier straps 6,8 over the shoulders located shoulder area 20 and then tightens the carrier straps 6,8 by pulling down the two D-rings 18 of the buckle strap 2. Hereby both the size of the shoulder straps and the length of the infant holding straps is regulated by the same pulling action.

I claim:

1. An infant carrier comprising a semirigid seating plate member which is bendable for forming a seat portion and a backrest and for accommodating a child sitting astride said seat portion behind a front edge thereof, said front edge being connected with carrier straps which, in use, extend upwardly from said front edge, along a body of a person using the carrier to carry a child, to a first strap portion from which the straps continue upwardly and forwardly over shoulders of said person, leaving the shoulders downwardly at respective second strap portions, from which the straps continue rearwardly to respective connection joints at which the straps connect with respective sides of said backrest at an intermediate level spaced above said seat portion, adjustment means being provided for enabling tightening of the straps against the body of the person using the carrier between said second strap portions and said connection joints, and upper support strap means running, between opposed upper side areas of said backrest and said first strap portions of said carrier straps, at a height above said intermediate level.

2. An infant carrier according to claim 1, in which the carrier straps intercross underneath the seat portion.

3. An infant carrier according to claim 1, in which at least one of said upper support strap means is connected to a respective first strap portion by releasable coupling means.

4. An infant carrier sling according to claim 1, in which the seating plate member, is formed of a flexible, cloth covered cushion plate.

5. An infant carrier according to claim 4, in which a seat area of the cushion plate is quilted.

6. An infant carrier according to claim 1, wherein the upper support strap means comprises an upper end portion of each of the carrier straps which is releasably connected to the first portion of the carrier straps respectively.

7. An infant carrier according to claim 1, wherein an adjustment strap extends between the upper support strap means across the rear of said backrest.

8. An infant carrier according to claim 7, wherein said adjustment strap is lengthwise adjustable via a buckle.

9. An infant carrier according to claim 1, wherein said adjustment means comprises a free end portion of each of said second portions of said carrier straps which includes a buckle thereon, said connection joints each comprising a strap adjustably mated with said buckle thereon said connection joints each comprising a strap adjustably mated with said buckle.

* * * * *